United States Patent [19]

Millard

[11] Patent Number: 4,508,316

[45] Date of Patent: Apr. 2, 1985

[54] CABLE DRIVEN JACK

[76] Inventor: Ralph A. Millard, 119 W. Waterloo Rd., Akron, Ohio 44319

[21] Appl. No.: 488,099

[22] Filed: Apr. 25, 1983

Related U.S. Application Data

[63] Continuation-in-part of Ser. No. 275,887, Jun. 22, 1981, abandoned.

[51] Int. Cl.[3] ..... B66F 7/02

[52] U.S. Cl. ..... 254/4 R; 254/387

[58] Field of Search ..... 254/4 R, 4 B, 4 C, 47, 254/387; 414/10, 11; 248/354 P, 161, 159

[56] References Cited

U.S. PATENT DOCUMENTS

| | | | |
|---|---|---|---|
| 989,744 | 4/1911 | Wilmot | 254/387 |
| 1,306,431 | 6/1919 | Klemme . | |
| 2,562,679 | 7/1951 | Ort . | |
| 2,653,785 | 9/1953 | La Russa . | |
| 2,983,474 | 5/1961 | Hanna | 254/387 |
| 3,109,626 | 11/1963 | Arnes et al. | 254/134 |
| 3,337,187 | 8/1967 | Sumner | 254/387 |
| 3,861,647 | 1/1975 | Meredith . | |
| 3,891,184 | 6/1975 | Fields | 254/387 |

FOREIGN PATENT DOCUMENTS

| | | | |
|---|---|---|---|
| 1046094 | 12/1953 | France | 248/354 P |

*Primary Examiner*—Robert C. Watson

*Attorney, Agent, or Firm*—Reese Taylor

[57] ABSTRACT

A mechanically operated, cable driven jack includes a base, a hollow upright support member secured to the base, a first hollow support tube telescopically received in the support member, and a second hollow support tube telescopically received within the first support tube. The first and second support tubes are interconnected by means of a cable and a series of sheaves and driven by a winch employing a worm gear drive principle so as to move the first and second support tubes from collapsed condition to an extended position. Safety means are also provided to limit the downward movement of the tubes and the arrangement of the pulley sheaves and the cable drive is such that upward movement is also controlled. Modifications of the jack include the provision of selected alternate attachment points for the free end of the cable so as to enable the jack to be modified for fast or slow movement, depending upon the precise engagement point of the free end of the cable. A further feature of the invention is the provision of an improved saddle capable of use with any of the forms of the invention and also capable of adjustment to accommodate varying sizes of transmissions and of tilting in several planes so as to facilitate removal of the transmission from particularly restricted environments, depending upon the make and model of the vehicle involved.

5 Claims, 19 Drawing Figures

CABLE DRIVEN JACK

RELATED APPLICATIONS

This Application is a continuation-in-part of Applicant's earlier filed Application, Ser. No. 275,887, filed June 22, 1981 now abandoned.

BACKGROUND OF THE INVENTION

This invention relates, in general, to jacks or other lifting devices and relates, in particular, to a jack having particular application to handling automotive transmissions.

DESCRIPTION OF THE PRIOR ART

The general prior art known to Applicant involves the utilization of hydraulic jacks which are hydraulically and mechanically driven and which employ a base and a telescoping tube which is capable of being extended from the base in response to hydraulic pressure.

The difficulties involved with these known types of jacks are primarily ones of maintenance. While the jacks themselves will generally perform for the purpose for which they are designed, practical experience proves that there are constant problems with failure. This failure is particularly common with regard to the seals which are necessary to maintain the entire lifting system in a fluid tight condition. Not only is seal failure inconvenient because, of course, it necessitates removing the jack from service, but it is also uneconomical because of the repair cost.

Furthermore, seal failure in a conventional hydraulic type jack of the character under consideration here presents potential safety problems because of the significant weights which the jack is designed to carry. In this regard, it should also be noted that in use of these jacks for handling transmissions, the automotive vehicle itself will be elevated on a conventional lift and the jack will be installed beneath the vehicle and extended to engage the transmission for removal and repair. A normal, extended lift in this situation would be on the order of 72 inches so that the generally heavy transmission mechanisms are supported at an elevation above the operator. Naturally, jack failure of any type when carrying such a heavy load presents potentially serious safety problems.

Additionally, it is often advantageous to provide for varying speeds of extension and retraction on the jack so as to facilitate use of the same depending upon the elevation of the vehicle from the support surface or floor.

Furthermore, in many instances, the transmissions will vary in size. The conventional saddles or support members which actually receive the transmission and which are received on the top of the furthest extended support tube have been, in the past, made adjustable. The conventional adjustment, however, requires the loosening of four screws at the four corners of the saddle, followed by sliding components in or out with regard to the center point of the saddle, and then retightening of the screws. Facilitating this adjustment feature and simplifying it is a desirable objective.

Additionally, many vehicles are constructed so that the area in which the transmission is located in the drive train is severely constricted. It is, therefore, believed to be advantageous to be able to tilt or tip the saddle in various directions so as to facilitate removal of the transmission once it has been disengaged from the drive train. While this is a desirable feature, it is also necessary to consider the signfiicant weight involved and the safety of the operator so that such tilting or adjustment of the saddle to facilitate removal must be controlled.

BRIEF DESCRIPTION OF THE INVENTION

It has been found that the difficulties encountered with the conventional hydraulically operated jacks can be obviated by employing a jack which is essentially entirely mechanically operated. This approach avoids any problem with seals and thereby makes the jack more economical to operate and maintain. It also makes the jack more economical to construct.

Accordingly, it has been found that a jack, comprising a base, a hollow support member projecting upwardly from the base, a first telescoping hollow support tube, and a second telescoping hollow support tube, can all be interconnected by a cable drive attached to a winch which is powered by a worm gear. In this fashion, the inherent difficulties encountered with the conventional jacks can be avoided.

It is also possible to provide safety means to prevent the jack from telescoping in the down position to an undesirable degree and also to control, by positioning of the pulleys employed on the first and second telescoping members, upward movement so as to maintain the jack in a stable condition at all times.

It has also been found that employment of the worm gear prevents any inadvertent retraction of the jack since, by its nature, the gear cannot be moved in the reverse or retracting direction merely by the weight of the supported object. It requires positive operator manipulation of the gear to retract and, in this way, the safety characteristics of the jack can also be improved.

A modified form of the invention has also been developed which even further enhances the effectiveness of the jack and in which the cable has a free end. The first and second hollow support tubes and the support member have selected alternative securing positions for engagement with the free end of the cable so as to alter, as desired, the speed with which the jack can be moved from the retracted to the extended position.

It has also been found advantageous to provide an improved saddle or support for the transmission which is capable of quick and easy expansion from one size to another to accommodate varying sizes of transmissions and which is also capable of tipping or tilting from front to rear and from side to side so as to permit the transmission to be removed from virtually any vehicle regardless of the physical characteristics of the vehicle.

Accordingly, production of an improved jack of the type above described becomes the principal object of this invention with other objects thereof becoming more apparent upon a reading of the following brief specification considered and interpreted in view of the accompanying drawings.

OF THE DRAWINGS

BRIEF DESCRIPTION OF THE PREFERRED EMBODIMENTS

The Embodiment of FIGS. 1 Through 6

Figure 1:
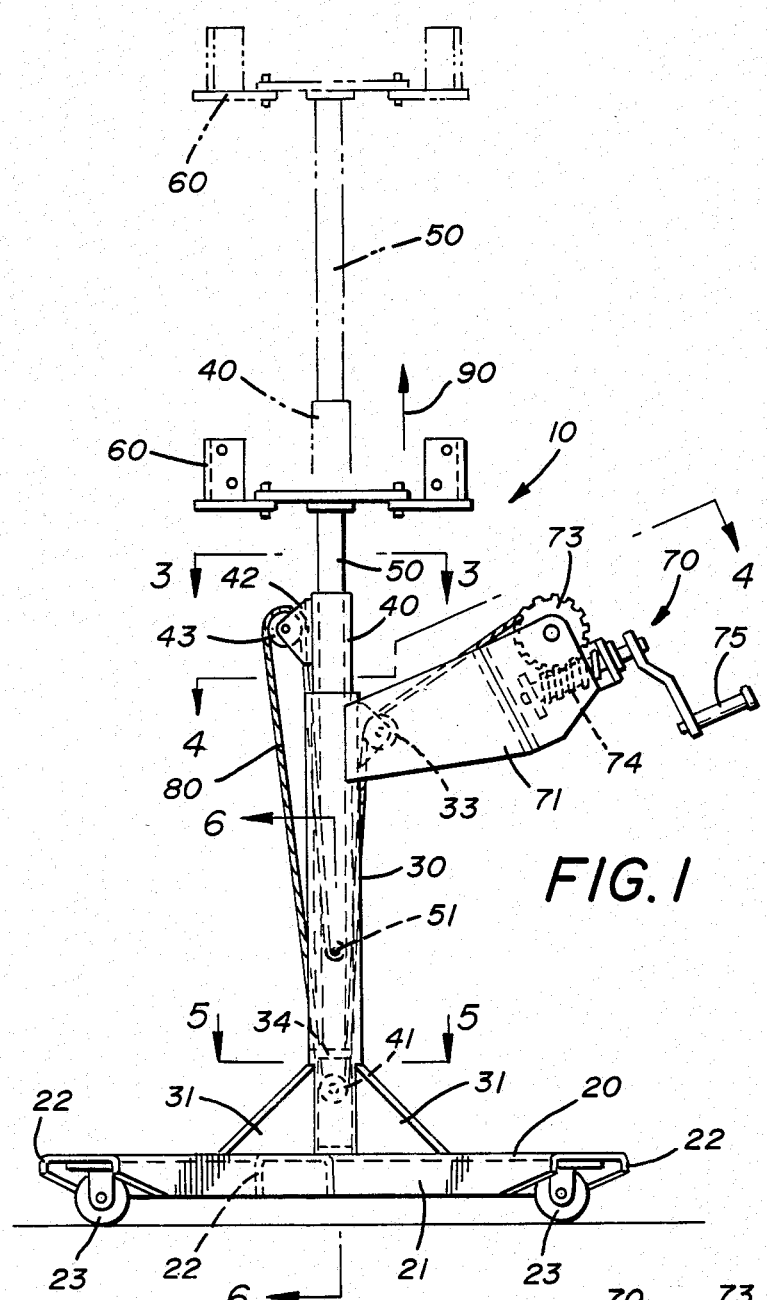
FIG. 1 is an elevational view showing the improved jack in its retracted position.
Figure 3:
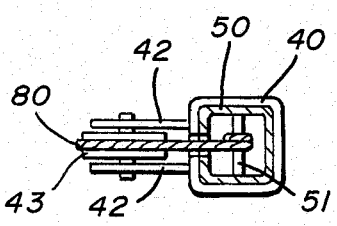
FIG. 3 is a sectional view taken along the line 3—3 of FIG. 1.
Figure 5:
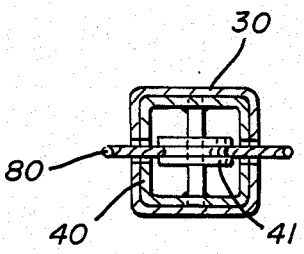
FIG. 5 is a sectional view taken along the line 5—5 of FIG. 1.
Figure 4:
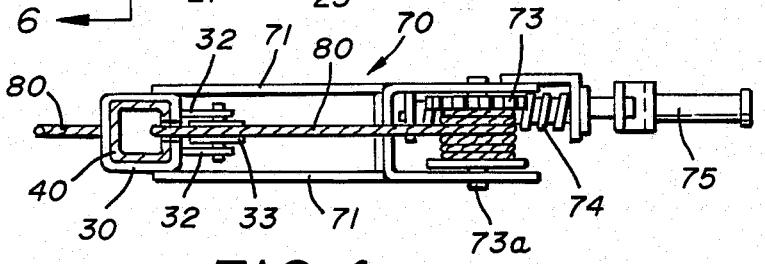
FIG. 4 is a sectional view taken along the line 4—4 of FIG. 1.

Referring first then to FIG. 1 of the drawings, it will be noted that the jack assembly, generally indicated by the numeral 10, includes a base 20, a hollow upright support member 30, a first hollow support tube 40, a second hollow support tube 50, a carrying saddle 60, and a winch and gear mechanism 70.

Still referring to FIG. 1 of the drawings and referring first to the base 20, it will be noted that this base essentially includes a star-shaped plate 21 which has four legs 22,22 arranged in crossing relationship. Secured to the outboard ends of these legs 22 are wheels 23,23 which are attached thereto in conventional fashion. In this manner, the base 20 is readily portable as is the jack structure which is mounted thereon and which will now be described.

Figure 2:
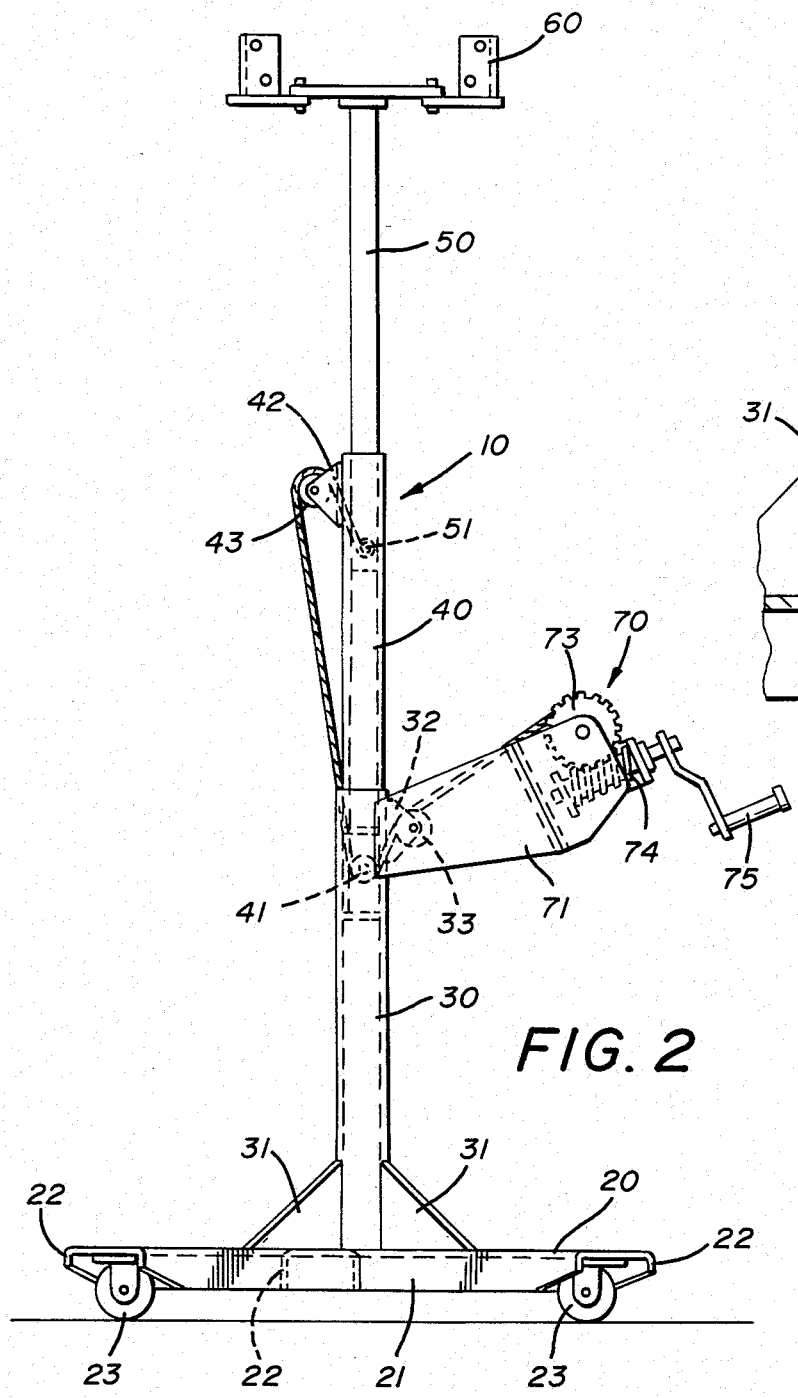
FIG. 2 is an elevational view similar to FIG. 1 showing the improved jack in extended position.

Referring to FIGS. 1 and 2, it will be noted that hollow upright support member 30 is an elongate hollow tube which may be secured to the base plate 21 by any desired method, such as by welding as indicated at 30*a*. As illustrated in FIGS. 1 and 2, for increased support and stability purposes, angle plates 31,31 can also be employed to give increased rigidity to the mounting and attachment of the tube 30.

Telescopically received within the hollow upright support member 30 is the first support tube 40. This, again, is a hollow member and it has an external dimension sufficient to enable it to slide within the interior of the first support member 30. Adjacent the lower end of the first support tube 40, a first pulley or sheave 41, is secured within the interior of the tube for purposes which will be described. It should be noted that the pulley 41 is preferably spaced from the end of the tube 40 to enhance stability when the jack is in its extended position as will be described below. Adjacent the upper end of first support tube 40, mounting plates 42,42 are secured on the outer wall and these plates 42,42 rotatably carry a second pulley or sheave 43.

Telescoped within the first support tube 40 is a second support tube 50. This tube is also hollow and it has a cross member 51 attached interiorly adjacent its lower end. Cross member 51 is also preferably spaced from the lower end of tube 50 for enhanced stability when the jack is in extended position, as will be described.

The saddle or carrying member 60 is secured at the top or exposed end of the second tube 50. This saddle or carrying member 60, which is the load carrying structure, will not be described in any great detail since, as illustrated in FIGS. 1 through 6, it is more or less conventional in nature.

Mounted on the outer wall of the upright support member 30 also are another pair of support plates 32,32 which rotatably carry a third pulley or sheave 33 between them.

Also mounted on the exterior surface of the upright support member 30, adjacent third pulley 33, is a winch and gear mechanism 70 which includes support plates 71,71 which carries the worm gear assembly. This assembly includes the usual gear 73 mounted on shaft 73*a*, worm 74, and the usual crank or handle 75.

The cable 80 has one end secured to the shaft 73*a* of the winch and gear assembly 70. This cable is then threaded over the third pulley 33, beneath the first pulley 41, over the second pulley 43, and attached to the cross member 51 of the second support tube 50.

When the winch mechanism 70 is activated by turning the handle 75, the cable will be taken up on the shaft 73*a*. This will cause the second support tube 50 to move to an upward direction indicted by arrow 90. As the tube approaches the point where the cross member 51 is just below the center point or horizontal axis of the second pulley 43, the second support tube 50 will cease upward movement.

Continued actuation of the winch, however, will then cause first support tube 40 to move upward and that tube will move upwardly until the first pulley 41 is disposed just beneath center point or horizontal axis of the third pulley 33. At that time, the jack will be in its fully extended position as shown in full lines in FIG. 2. Any weight applied to the saddle 60 will be adequately supported and there is no danger, due to the physical properties of the worm gear arrangement, of any inadvertent retraction of the tubes since torque applied to the gear 73 will not turn the worm 74.

It will also be noted that by spacing pulley 41 and cross member 51 from the bottom ends of the first and second support tubes, respectively, that a portion of each tube will be retained within its respective receiving member to insure stability and rigidity.

Turning the handle 75 in the reverse direction will, of course, result in retracting the first and second support tubes 40 and 50 in reverse order. It ought to be noted here that on the upward movement, the weight of the transmission, assuming one to be seated on saddle 60, will cause first support tube 40 to move upwardly first followed, upon tube 40 reaching its upper most position, by movement of the second support tube 50. On downward movement, the second support tube 50 will move downward first followed by the first support tube 40.

Figure 6:
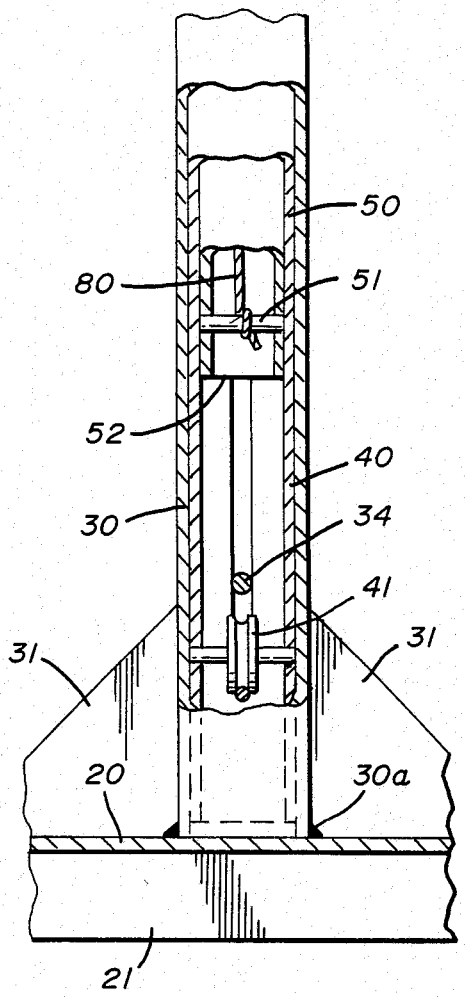
FIG. 6 is a sectional view taken along the line 6—6 of FIG. 1.

Also mounted within the first support tube 40 is a pin 34 which extends from one side to the other and this pin serves to bottom out and engage the bottom edge 52 of the second tube 50 thereby ensuring that the tube 50 does not retract downwardly to an undesirable degree. This arrangement also protects first pulley 41. Also, the bottom edge of first support tube 40 will bottomout on plate 20 as also shown in FIG. 6.

The Embodiment of FIGS. 7 Through 14

The modified form of the invention incorporates the advantages, in general, of the form of the invention shown in FIGS. 1 through 6 with still further features primarily directed to the ability to alter the speed with which the device extends and retracts by selective adjustment of the drive means with the telescoping tubes.

Turning then to FIGS. 7 through 14, it will be seen that essentially a two speed operation is possible with the modified form of the invention.

This form of the invention includes a base 120 mounted on wheels 123 and having an upright support member 130 similar to that of the form of the invention illustrated in FIGS. 1 through 6.

Drive means 170 are mounted on support bracket 171 and generally include a worm type drive also similar to that illustrated, for example, in FIGS. 1 and 2 of the drawings. The cable 180 has one end attached to the shaft 173*a* of the drive means so that turning of the handle 175 will engage gear 173 to raise or lower the telescoping first and second suport tubes 140 and 150.

The most significant feature in the embodiment of FIGS. 7 through 14, however, is the fact that the extension and retraction speed can be adjusted depending upon the manner in which the cable 180 is attached and threaded on the various sheaves.

To that end, the first support tube 140 carries first sheave 141 pinned adjacent its bottom end. This support tube 140 also carries a second sheave 143 mounted on a bracket 142 adjacent the outboard end of the first support tube 140.

Second support tube 150 carries a third sheave 151 adjacent its bottom end.

Figure 7:
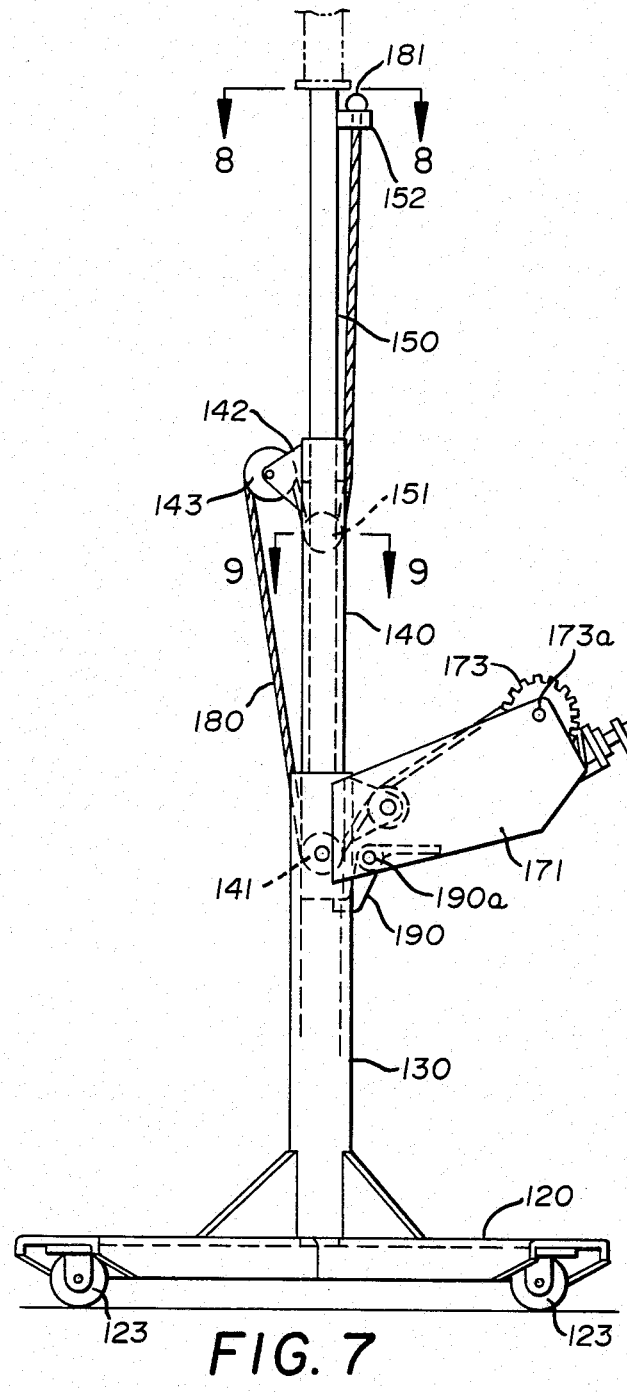
FIG. 7 is an elevational view of a modified form of the invention in extended position.
Figure 8:
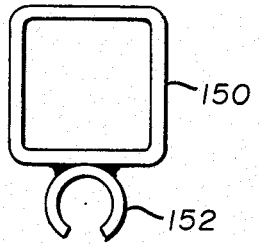
FIG. 8 is a sectional view taken along the line 8—8 of FIG. 7.
Figure 9:
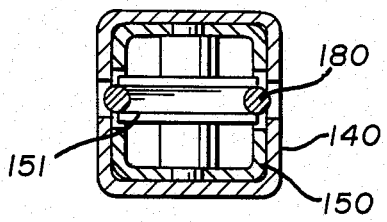
FIG. 9 is a sectional view taken along the line 9—9 of FIG. 7.

In the form of the invention illustrated in FIGS. 7 through 9 of the drawings, it will be seen that the cable 180 is threaded beneath first sheave 141, over second sheave 143, and under third sheave 151. An attachment member 152 is disposed at the top of the second support tube 150 and it receives the ball 181 which is carried by the free end of the second support tube 150.

This is essentially the high speed operating mode and can be utilized two ways. First, tube 150 can simply be pulled to its extended position, following which the ball 181 is engaged. This eliminates cranking to the extent normally necessary to attain full extension of second tube 150 although, to obtain full extension of tube 140, cranking would still be required. Alternatively, the ball could be engaged first and the tubes can then be cranked to extended position. In that case, the increase in overall extension speed is about 2:1 over the mode of FIGS. 1 through 6. In either case, retraction is unaffected and full retraction is possible.

Figure 11:
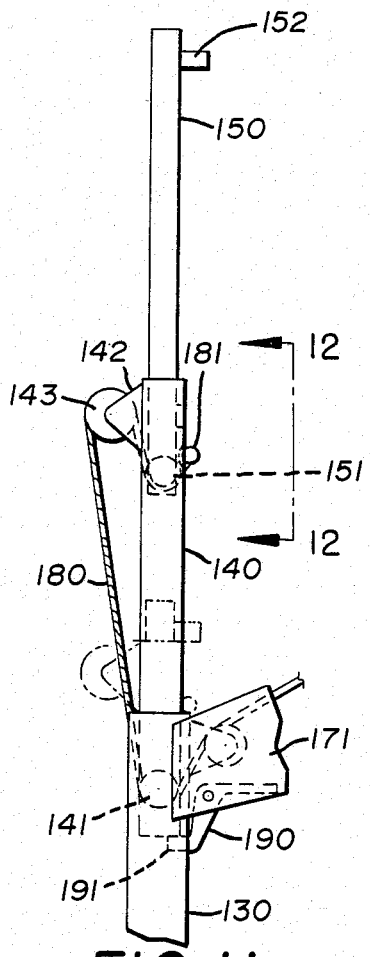
FIG. 11 is a partial elevational view showing the form of the invention of FIG. 7 in a different operational mode in extended position.
Figure 12:
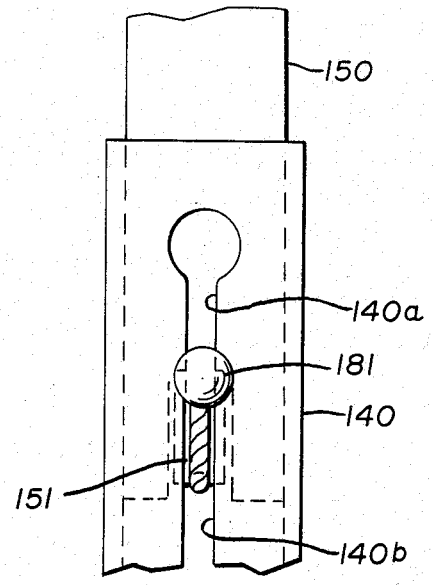
FIG. 12 is an enlarged view taken along the line 12—12 of FIG. 11.

FIGS. 11 and 12 show the device in a second operating mode in which the cable 180 is threaded under the first sheave 141, over the second sheave 143, under the third sheave 151, and is secured in an aperture 140*a* in the wall of the first support tube 140 opposed to the mounting bracket 142. The keyhole shape of aperture 140*a* enables ball 181 to pass through the enlarged portion thereof and then be trapped against the top shoulder of slot 140*b*, which extents the length of tube 140. This is the second speed operation and makes use of the third sheave 151 to achieve an extension rate which is slower than that just described.

Figure 14:
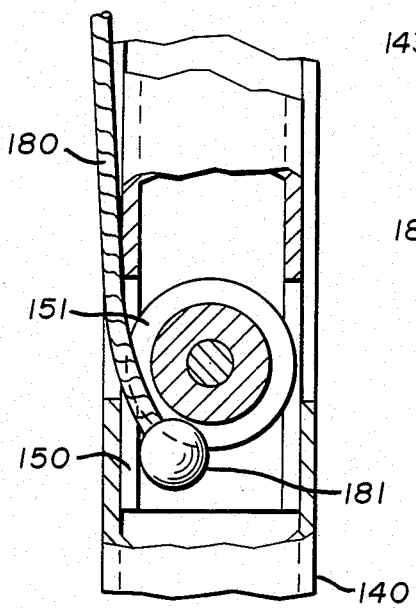
FIG. 14 is an enlarged fragmentary view, partially broken away, of FIG. 13.
Figure 13:
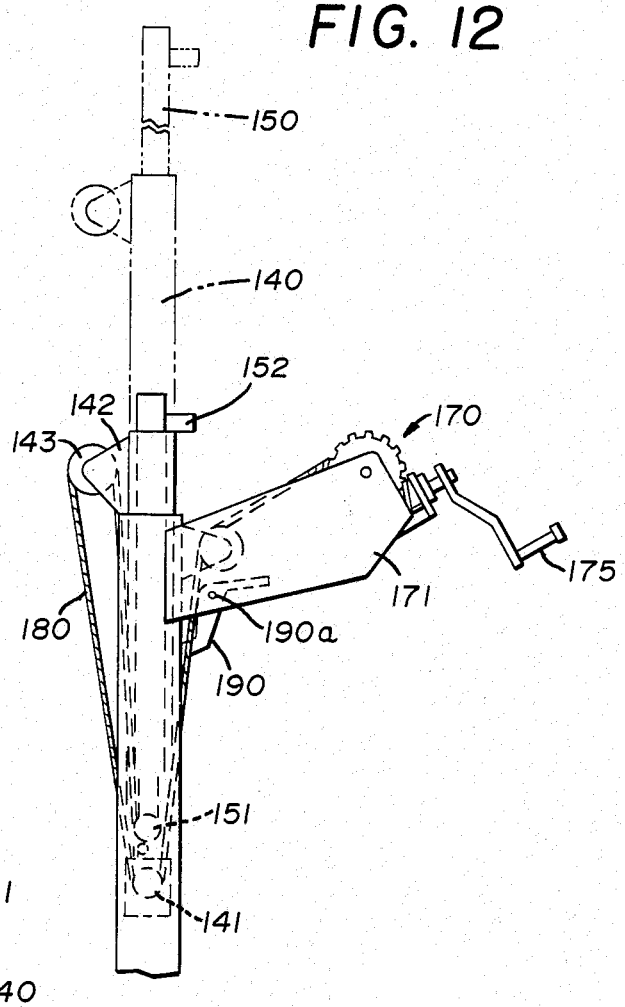
FIG. 13 is a partial elevational view showing the modified form of the invention of FIG. 7 in still another operational mode.
Figure 15:
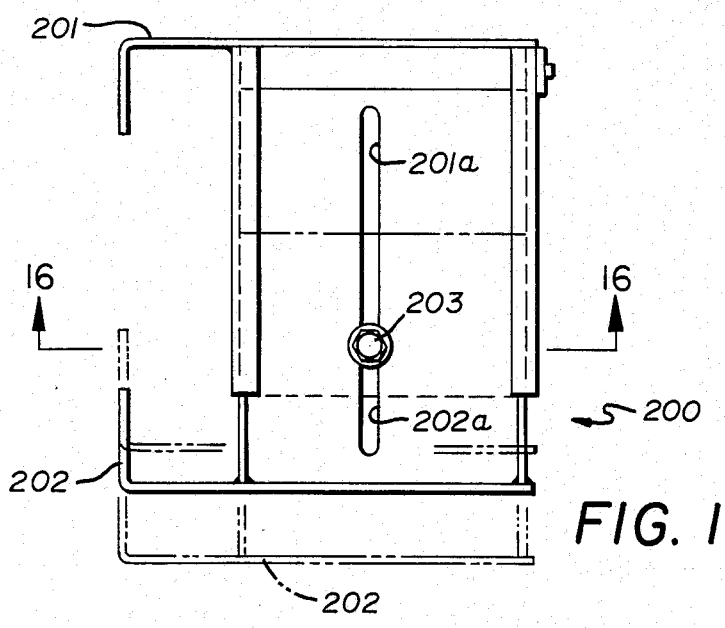
FIG. 15 is a plan view of an improved saddle.
Figure 16:
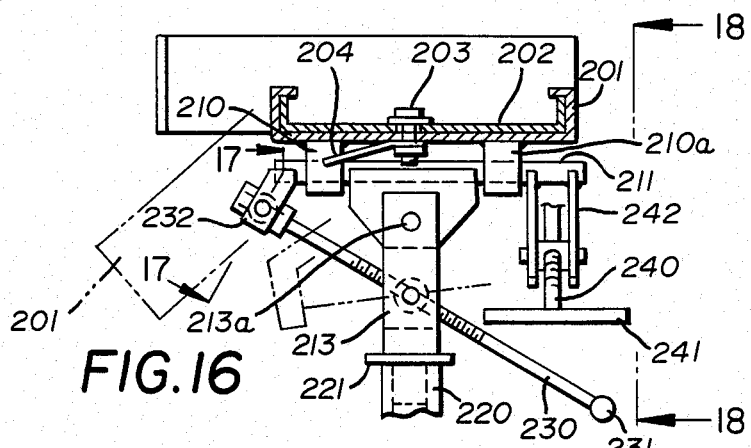
FIG. 16 is a sectional view taken along the line 16—16 of FIG. 15.
Figure 17:
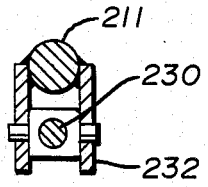
FIG. 17 is a sectional view taken along the line 17—17 of FIG. 16.
Figure 18:
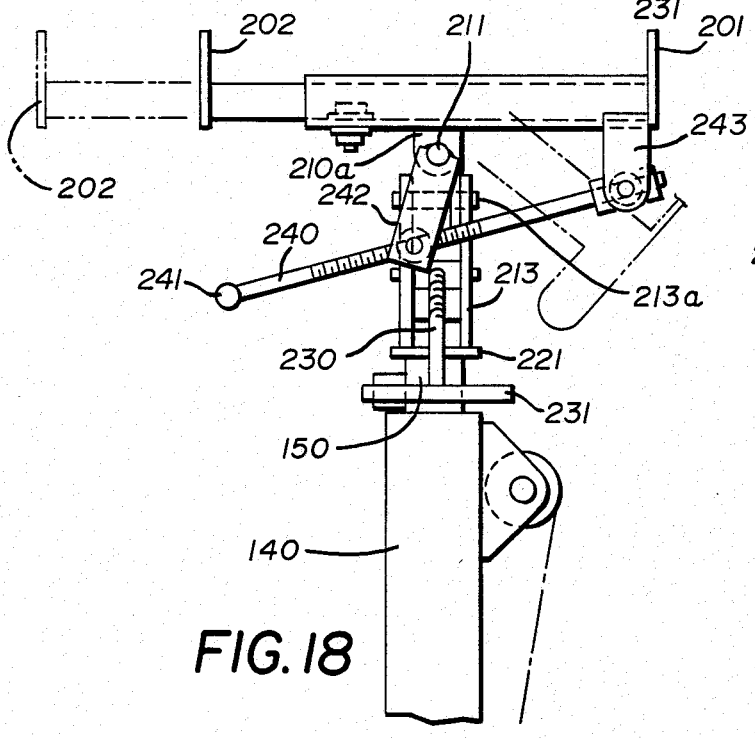
FIG. 18 is an elevational view taken along the line 18—18 of FIG. 17.
Figure 19:
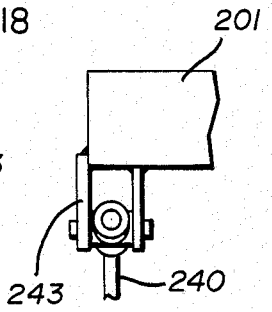
FIG. 19 is a partial elevational view taken from the right of FIG. 18.

The third operating mode, which is really a modification of the first, can be seen in FIGS. 13 and 14 of the drawings wherein the cable 180 passes beneath the first sheave 141, over the second sheave 143, and has the ball 181 trapped between the third sheave 151 and the side of the second support tube 150, as shown in FIG. 14. This mode of operation achieves an extension rate similar to that of FIG. 7 but without the manual extension option.

FIGS. 7 through 14 also illustrate an improved safety feature in that a locking member 190 is pinned to the bracket 171 which supports the winch 170. This is essentially an S-shaped stop which prevents inadvertent retraction once the device has been extended to its fully extended position. In that regard, as noted, the arm 190 is pinned at 190*a* for freely pivoting movement and has a lip 191 which fits into an elongate slot in the upright member 130. As the tube 140 passes in its upward movement, this arm simply pivots about its mounting point and the lip 191 drops into the slot 140*b* beneath the bottom or inboard end of the tube 140 to prevent it from being inadvertently retracted, as clearly shown in FIG. 7. It is, therefore, possible, of course, when it is desired to retract, to simply pivot the arm 190 out of the way and reverse the crank 175, as clearly shown in FIG. 10.

Figure 10:
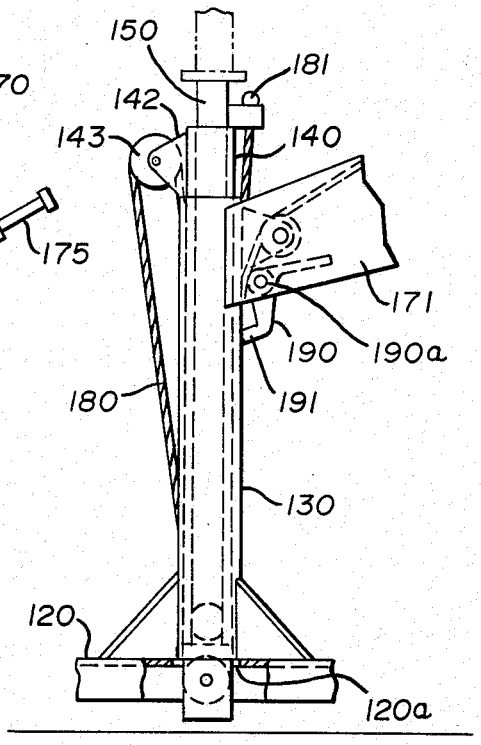
FIG. 10 is an elevational view of the form of the invention of FIGS. 7 through 9 in retracted position.

A further feature of the embodiment of FIGS. 7 through 14 can be seen in FIG. 10. The base 120 is provided with a through central aperture 120*a*. Since the base is elevated by wheels 123 from the floor, this permits first support tube 140 to pass through the base a limited distance.

This has the advantage of permitting greater extension without affecting the overall height of the unit in the retracted position. For example, extending tube 140 a distance of $3\frac{1}{2}$ inches through plate 120 permits 7 inches of additional extension. Since the jack will normally have to be rolled under such obstacles as the vehicle lift, this has obvious advantages.

The Modification of FIGS. 15 Through 19

The saddle 200 disclosed in FIGS. 15 through 19 includes a first plate 201 and a second plate 202. Plate 202 is slidably received on plate 201. A locking member 203 is fixed to first plate 201 and is secured to a handle 204. The second plate 202 has an elongate slot 202*a* through which the head of locking member 203 is received. When it is desired to expand the saddle 202 from, for example, the full line position to the broken line position of FIG. 15, handle 204 is turned to release the clamping pressure of locking member 203 following which, plate 202 is moved the desired distance and is reclamped. This permits proper accommodation of the load, which, considering the weights involved, is important.

The bottom surface of first plate 201 has a pair of depending journals 210,210*a*. These receive an elongate shaft 211. Fixed to shaft 211 is a bracket 212. This bracket has a U-shaped support 213 pinned to it for pivoting movement at 213*a*, as will be described. Fixed to and depending from support 213 is a shaft 220 having a radially enlarged plate 221. This enables shaft 220 to be removably located in the top of second support tube 50 (FIG. 1) or 150 (FIG. 7) and also to be rotatable about its longitudinal axis for proper positioning and alignment.

In order to permit saddle 200 to be tilted in various planes to facilitate removal and manuevering in restricted areas, saddle 200 also has adjustment means connected to first plate 201.

Thus, first elongate, threaded arm 230, having an operating handle 231 on one end, is threadedly engaged with support 213 intermediate its ends and has its opposed end attached to first plate 201 by bracket 232. By turning handle 231, and thus arm 230, the plates 201 and 202 can be tilted from the full line position of FIG. 16 to the broken line position thereof. Keeping in mind that shaft 220 and support 213 are fixed in a vertical plane by insertion in tube 50 or 150, it will readily be seen that the adjustment screw 230 will cause the plates to pivot about mounting point 213*a*.

The just described tilting may be characterized as "front-to-rear" for purposes of this description. Tilting is also possible in what may be termed as "side-to-side" plane.

Thus, a second, elongate, threaded arm 240 is also provided. This arm has a handle 241 on one end and is threaded through a bracket 242 secured to shaft 211. The opposed end of shaft is attached to plate 201 by bracket 243. Here again, turning adjustment screw or arm 240 will tilt the plates from the full line position to the broken line position of FIG. 18.

It has been found that the structure just described permits tilting on the order of 45° from the horizontal which has proved satisfactory in practice to accommodate most instances of restricted working conditions.

It should also be noted that the improved saddle has utility with all forms of the basic jack disclosed herein and may well have separate utility as well.

While a full and complete description of the invention has been set forth in accordance with the dictates of the Patent Statutes, it should be understood that modifications can be resorted to without departing from the spirit hereof or the scope of the appended claims.

What is claimed is:

1. A jack, comprising:

(A) a base;

(B) a hollow upright member secured to and projecting from said base;

(C) a first support tube telescoped within said upright member;

(D) a second support tube telescoped within said first support tube;

(E) drive means carried by said upright and selectively engaging said first and second support tubes to move said tubes between retracted and extended positions with respect to said upright member at different speeds; and (F) said drive means including (1) a winch mounted on said upright member and (2) a cable having one end secured to said winch; and (3) attachment means carried by said first and second support tubes for releasably and selectively engaging the opposed end of said cable.

2. The jack of claim 1 wherein (A) a first sheave is disposed adjacent the inboard end of said first support tube;

(B) a second sheave is disposed adjacent the outboard end of said first support tube; and (C) a third sheave is disposed adjacent the inboard end of said second support tube.

3. The jack of claim 2 wherein (A) said attachment means include a first cable engagement means disposed adjacent the outboard end of said second support tube;

(B) said cable passing beneath said first sheave, over said second sheave, beneath said third sheave, and having its opposed end secured to said first engagement means.

4. The jack of claim 2 wherein (A) said attachment means include second engagement means disposed adjacent the inboard end of said first support tube in opposed relationship with second sheave;

(B) said cable passing beneath said first sheave, over said second sheave, beneath said third sheave, and having its opposed end secured to said second engagement means.

5. The jack of claim 2 wherein (A) said attachment means include third engagement means disposed adjacent the inboard end of said second support tube;

(B) said cable passing beneath said first sheave and over said second sheave and having its opposed end secured to said third engagement means.

* * * * *